US008398449B2

(12) United States Patent
Forti

(10) Patent No.: US 8,398,449 B2
(45) **Date of Patent: *Mar. 19, 2013**

(54) METHOD AND APPARATUS FOR BODY-WORN ENTERTAINMENT DEVICES

(75) Inventor: William Mark Forti, Claremont, CA (US)

(73) Assignee: William Mark Corporation, Claremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/303,700

(22) Filed: Nov. 23, 2011

(65) Prior Publication Data

US 2012/0066883 A1 Mar. 22, 2012

Related U.S. Application Data

(62) Division of application No. 12/111,875, filed on Apr. 29, 2008.

(60) Provisional application No. 61/019,174, filed on Jan. 4, 2008.

(51) Int. Cl.
*A63H 27/04* (2006.01)

(52) U.S. Cl. ..... 446/26; 446/24; 446/28; 446/30; 446/31; 446/32; 446/34; 446/46; 446/48; 446/82; 446/83; 446/223; 446/228; 446/251; 446/268; 446/317; 446/329; 446/331; 273/317; 273/329; 273/331; 244/153 R; 244/155 A; 472/57; 472/68; 472/70; 472/80; 472/133

(58) Field of Classification Search ..... 446/24, 446/26, 28, 30–32, 34, 46, 48, 82–83, 223, 446/228, 251, 268, 315, 901; 273/317, 329, 273/331; 244/153 R, 155 A; 472/57, 68, 472/70, 80, 133

See application file for complete search history.

(56) References Cited

U.S. PATENT DOCUMENTS

| | | | | |
|---|---|---|---|---|
| 1,153,155 | A | 9/1915 | Fritsch | |
| 2,561,760 | A | 7/1951 | Stifter | |
| 2,539,979 | A | 4/1952 | Calhoun | |
| 2,601,409 | A | 6/1952 | McArthur et al. | |
| 2,921,743 | A | 1/1960 | Westover et al. | |
| 2,947,108 | A | 8/1960 | Dood, Jr. et al. | |
| 2,958,156 | A | 11/1960 | Schimahl et al. | |
| 2,968,119 | A | 1/1961 | Glass et al. | |
| 3,030,733 | A * | 4/1962 | Crawford | 446/30 |
| 3,087,277 | A * | 4/1963 | McCook | 446/27 |
| 3,107,452 | A | 10/1963 | Berger | |
| 3,136,460 | A * | 6/1964 | Ruderian | 224/249 |
| 3,138,356 | A * | 6/1964 | McClain | 244/155 A |
| 3,161,988 | A | 12/1964 | Junker | |
| 3,742,644 | A * | 7/1973 | Williams | 446/366 |
| 3,787,013 | A | 1/1974 | McKenzie, Sr. | |
| 3,802,117 | A | 4/1974 | Englehardt | |
| 3,844,557 | A | 10/1974 | Pompetti | |
| 3,858,872 | A | 1/1975 | Summerfield et al. | |
| 3,863,924 | A * | 2/1975 | Gagnon | 273/335 |
| 3,893,256 | A * | 7/1975 | Wolf et al. | 446/228 |
| 3,976,297 | A * | 8/1976 | Seymour | 273/335 |

(Continued)

*Primary Examiner* — Gene Kim
*Assistant Examiner* — Alexander Niconovich
(74) *Attorney, Agent, or Firm* — Fish & Associates, PC

(57) ABSTRACT

A light-weight toy is attached to a player via a near-invisible fixed-length tether, typically using a low-tack adhesive at the ends of the tether. In especially preferred embodiments, the toy has a mechanism that creates an appearance of plausible possibility of flight without actually providing sufficient lift and/or propulsion for flight. Imaginary flight is achieved by manual lifting and moving the toy via the tether. Thus, the tether forms an integral part of the imaginary play for the player and is not used as an implement of a 'magic trick' for an audience.

20 Claims, 3 Drawing Sheets

U.S. PATENT DOCUMENTS 3,991,512 A 11/1976 Stanzel
3,997,136 A 12/1976 Finn et al.
4,047,323 A 9/1977 Biffi
4,135,711 A 1/1979 Holt
4,157,631 A 6/1979 Kifferstein et al.
4,159,087 A 6/1979 Moomaw
4,244,136 A 1/1981 Kublan
4,257,186 A 3/1981 Wilson
4,297,808 A 11/1981 D'Andrade
4,457,098 A 7/1984 Tsuzuki
4,552,314 A * 11/1985 Noguchi et al. ..... 242/476.6
4,715,564 A 12/1987 Kinn et al.
4,728,311 A * 3/1988 Magers ..... 446/228
4,802,875 A 2/1989 Cunningham
4,981,456 A * 1/1991 Sato et al. ..... 446/36
4,982,641 A * 1/1991 Duhart ..... 84/329
5,118,054 A * 6/1992 Kirschenbaum et al. . 244/153 R
5,125,864 A * 6/1992 Roberson et al. ..... 446/268
5,188,314 A * 2/1993 Peters ..... 244/31
5,254,077 A * 10/1993 Nottingham et al. ..... 446/48
5,391,104 A * 2/1995 George ..... 446/177
5,547,413 A 8/1996 Murray
5,570,646 A * 11/1996 Mardix et al. ..... 112/278
5,634,839 A 6/1997 Dixon
5,709,580 A 1/1998 Stanzel
5,765,831 A * 6/1998 Huffhines ..... 273/348.4
5,816,877 A 10/1998 Chuang
5,867,913 A 2/1999 Pettigrew
6,019,661 A * 2/2000 Simpkins ..... 446/228
6,076,758 A * 6/2000 Kieves et al. ..... 242/400.1
6,135,388 A 10/2000 Hostetter
6,250,526 B1 * 6/2001 Bess ..... 224/275
6,283,816 B1 * 9/2001 Pascual ..... 446/34
6,311,425 B1 * 11/2001 Capps ..... 43/3
6,443,397 B1 9/2002 Morris
6,572,482 B1 * 6/2003 Lewis, Jr. ..... 472/9
6,581,879 B2 * 6/2003 Bellacera ..... 244/155 A
6,582,272 B1 6/2003 Nelson et al.
6,620,018 B1 * 9/2003 Chao et al. ..... 446/31
6,631,811 B2 * 10/2003 Komar et al. ..... 211/13.1
6,663,460 B1 * 12/2003 Nelson ..... 446/220
6,688,936 B2 * 2/2004 Davis ..... 446/37
6,748,890 B1 * 6/2004 Norment ..... 114/39.16
6,938,275 B1 * 9/2005 Fried ..... 2/162
6,962,309 B1 * 11/2005 Chang ..... 244/155 R
7,104,861 B2 * 9/2006 Kanahele et al. ..... 446/26
7,513,220 B2 * 4/2009 Ragonetti et al. ..... 119/707
2001/0034176 A1 * 10/2001 Deliu ..... 446/26
2002/0142699 A1 * 10/2002 Davis ..... 446/37
2002/0173216 A1 * 11/2002 Abel ..... 446/26
2003/0045202 A1 * 3/2003 Komar et al. ..... 446/221
2003/0124950 A1 * 7/2003 Turner ..... 446/236
2004/0116040 A1 * 6/2004 Mulvihill et al. ..... 446/247
2006/0157622 A1 * 7/2006 Johnston et al. ..... 244/154
2006/0183396 A1 * 8/2006 Kanahele et al. ..... 446/26
2006/0194504 A1 8/2006 Ragonetti et al.
2006/0217027 A1 * 9/2006 Martuccio ..... 446/46
2006/0292959 A1 * 12/2006 Greenwald et al. ..... 446/220
2008/0076322 A1 * 3/2008 Phillips ..... 446/220
2008/0085655 A1 * 4/2008 Boise ..... 446/220
2008/0085656 A1 * 4/2008 Boise ..... 446/220
2008/0230658 A1 * 9/2008 Waits et al. ..... 248/104
2009/0176433 A1 * 7/2009 Forti ..... 446/26
2009/0176434 A1 * 7/2009 Forti ..... 446/31

* cited by examiner

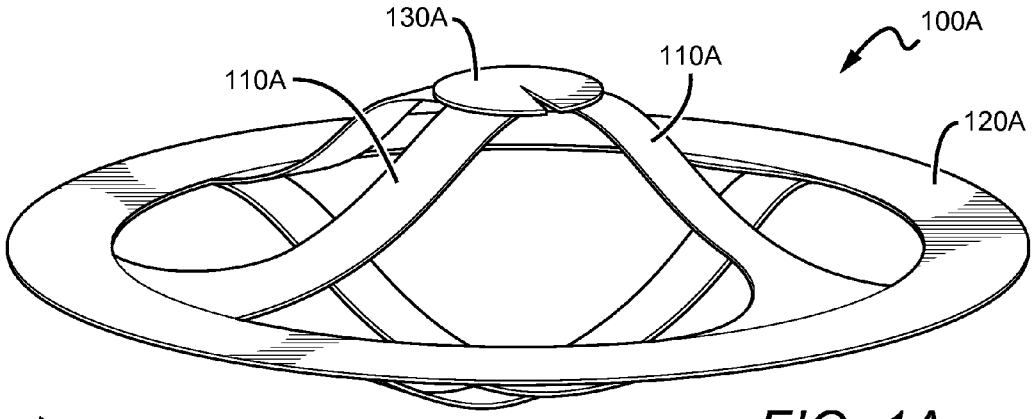
FIG. 1A
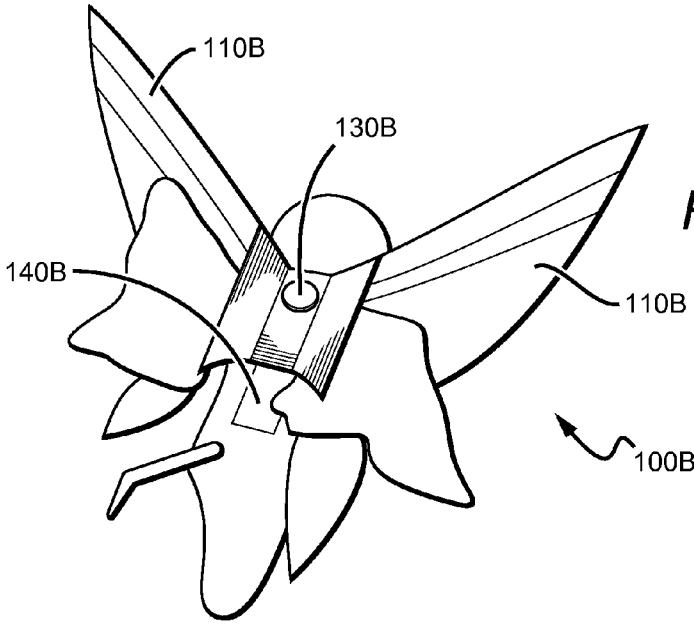
FIG. 1B
FIG. 1C
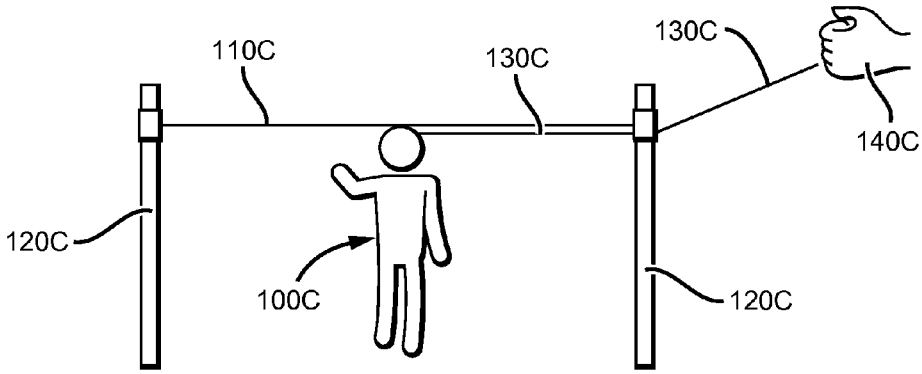

FIG. 2A
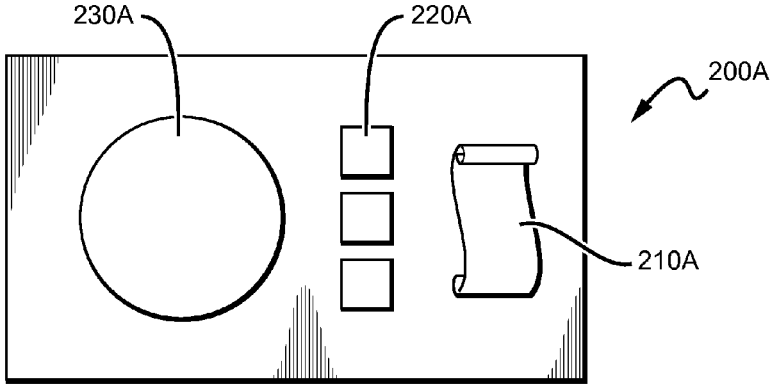
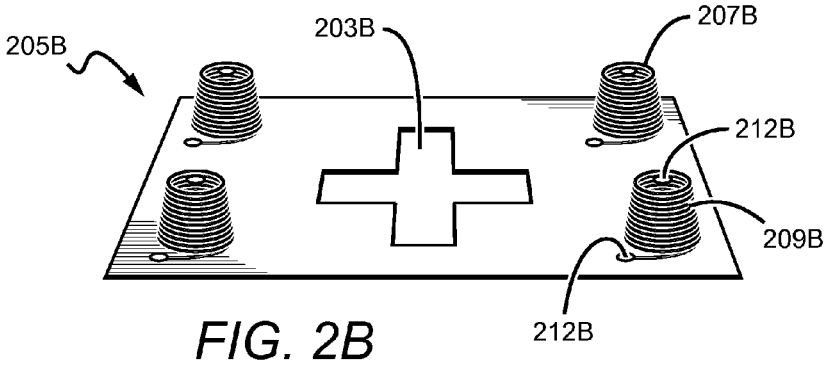
FIG. 2B
FIG. 3
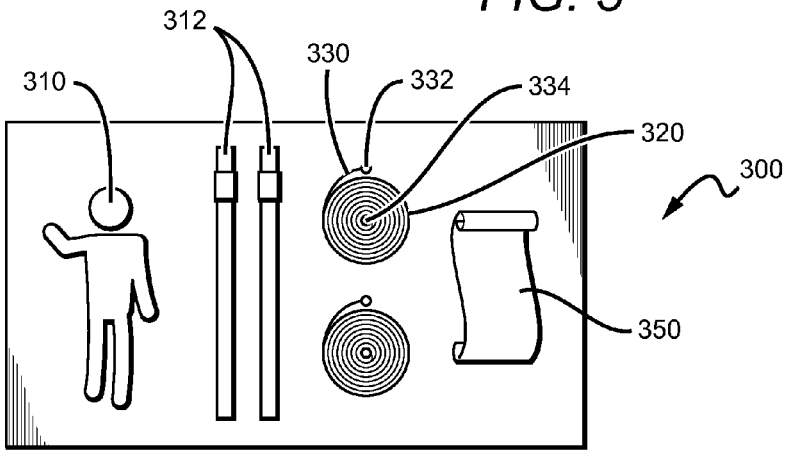

METHOD AND APPARATUS FOR BODY-WORN ENTERTAINMENT DEVICES

This application is a divisional application of copending U.S. application with the Ser. No. 12/111,875, which was filed Apr. 29, 2008, and also claims priority to U.S. provisional application with the Ser. No. 61/019,174, which was filed Jan. 4, 2008.

FIELD OF THE INVENTION

The field of the invention is body-worn toys, especially those that are suspended in the air using a visible or near-invisible tether that is coupled to a person and have appearance of plausible autonomous flight.

BACKGROUND OF THE INVENTION

There are numerous toys and 'magic tricks' known in the art in which one or more objects are suspended in the air using a visible or near-invisible tether. For example, mobiles or small airplanes often use visible relatively thick tethers to control the path of the suspended object or airplane.

For example, U.S. Pat. No. 6,572,482 teaches flying animals with moving wings that are, inter alia, suspended from a ceiling. Similarly, U.S. Pat. No. 3,893,256 teaches a toy plane that is coupled to a pair of tethers via a sleeve such that moving apart of the tethers by a user forces the toy along the path of the tethers to the point of tether attachment to a wall or post. Likewise, U.S. Pat. No. 4,244,136 discloses a suspension mechanism for toys in which a pulley system propels a carriage for a toy figure. Once one end of the pulley system is attached to a wall or other static structure, the player needs only one hand to propel to attached toy along the lines of the pulley system. Alternatively, the tether may be attached to a handle on one end and to a toy plane on the other end, and the player spins the toy using the handle in a circular motion as described in U.S. Pat. No. 4,047,323. Similarly, as described in U.S. Pat. No. 6,620,018, a flying toy is attached to a post or ceiling via a tether, but is propelled by a jet fan impeller to provide player-independent propulsion. While such known toys advantageously secure the object or airplane in a robust manner and even allow significant forces on the object or airplane, the tether typically precludes the illusion of free flight or levitation as the flight path is determined by the straight line of the tether between the point of attachment and the flying toy.

To overcome the disadvantages associated with fixed tether attachment to a post or wall, a toy may be suspended from a hand held scissor-like device as, for example, described in U.S. Pat. No. 4,257,186. While such attachment advantageously allows 'flying' of the toy along any desired path, control of the hand held scissor-like device may be difficult for younger players and detract from a first-person perspective of 'flying' experience.

In other known examples, and especially with many 'magic tricks' in which the path of a suspended object is controlled via a near-invisible tether, the object is generally an object that one would not expect to fly or levitate to so create surprise and/or disbelief. Unfortunately, and especially where such tethers are very thin, manufacture, storage, and performance, are often problematic. For example, near-invisible tethers are typically monofilaments or thin filament bundles having a thickness of about 10-80 microns (less than the thickness of a single human hair), making controlled handling very difficult due to the very low tensile strength and tendency to tangle. Worse yet, such tethers are generally not available as a commodity and must be prepared by separation and unwinding from a multi-filament yarn, which requires considerable dexterity, attention span, and time commitment. Still further, attachment of the tether to the object is often complicated due to the near-invisible nature of the tether. Therefore, set-up for 'magic tricks' that rely on such tethers is often cumbersome and typically precludes small children (e.g., 10 years and younger) from such entertainment.

Therefore, while numerous methods of entertainment devices are known in the art, all or almost all of them suffer from one or more disadvantages. Consequently, there is still a need to provide improved composition and methods to improve wear resistance in such products.

SUMMARY OF THE INVENTION

The present invention is drawn to body-worn toys and methods of use in which a light-weight toy is attached to a user via a near-invisible fixed-length tether using an adhesive, where the toy has a mechanism that imparts an appearance of plausible possibility of flight to the toy without actually providing sufficient lift or propulsion for flight. Therefore, flight and/or lift are entirely provided by the user's (typically manual) control of the tether.

In one aspect of the inventive subject matter, a toy kit includes a light-weight toy, and a near-invisible fixed-length tether having a length and first and second ends, wherein first and second ends are modified with an adhesive having a tackiness sufficient to allow reversible coupling of the first end of the tether to a person and to allow reversible coupling of the second end of the tether to the toy, and wherein the light-weight toy comprises a mechanism that imparts appearance of plausible possibility of flight to the toy without providing sufficient lift or propulsion for flight.

Especially preferred kits will include a packing element that is configured to allow coiled and reversible affixing of the near-invisible fixed-length tether to the packing element using the adhesive on the first and second ends, and the packing element most preferably has a spool that is configured to allow coiled and reversible affixing of the near-invisible fixed-length tether, and further optionally comprises an opening that is configured to accommodate at least a portion of the light-weight toy.

With respect to the light-weight toy it is preferred that the toy is configured as a toy fairy (e.g., having human appearance), as a butterfly, as a dragon, or as a dinosaur, and that the mechanism that imparts appearance of plausible possibility of flight comprises a pair of wings. Most preferably, such toys will include a control circuit that allows control of movement of the pair of wings as a function of proximity of the toy to a surface (e.g., floor of a room, bottom of a storage container, body surface, etc.), and/or a control circuit that allows control of illumination of the pair of wings (e.g., as a function of movement of the pair of wings). Alternatively, the light-weight toy may be configured as a UFO where the mechanism that imparts appearance of plausible possibility of flight comprises a plurality of airfoils.

Most typically, the adhesive is a low-tack adhesive (e.g., wax, poster putty, etc.), and the light-weight toy has a weight of between 5 and 50 gram. With respect to the tether it is preferred that the near-invisible fixed-length tether has a length of between 30 cm and 90 cm, typically a monofilament of filament bundle having a thickness of less than 120 micron. In still further contemplated aspects, the kit includes an instruction that instructs a user to attach the first end of the tether to the person and to attach the second end of the tether to the toy to thereby suspend the toy mid-air.

Therefore, in another aspect of the inventive subject matter, a method of providing a body-worn entertainment device will include a step of providing a light-weight toy according to the inventive subject matter and an instruction to a user to (a) attach the first end of the near-invisible fixed-length tether to a person and to attach the second end of the near-invisible fixed-length tether to the light-weight toy, and (b) support the near-invisible fixed-length tether with at least one finger (and/or another body portion (e.g., support behind/over ear)) at a position between the first and second ends.

In yet another aspect of the inventive subject matter, contemplated kits include a spool to which a near-invisible tether is releasably coupled using first and second adhesives at respective ends of the tether, and an articulated puppet that is configured to allow controlled movement of the puppet using the tether, preferably when the tether is in horizontal position and when the tether is coupled to a person using one end of the tether. Such kits may further include a post that is configured to allow coupling of the tether (typically longer than 90 cm) to the post such that the tether moves along the post.

Various objects, features, aspects and advantages of the present invention will become more apparent from the following detailed description of preferred embodiments of the invention, along with the accompanying drawing.

BRIEF DESCRIPTION OF THE DRAWING

FIG. 1A depicts one exemplary light-weight toy according to the inventive subject matter.

FIG. 1B depicts another exemplary light-weight toy according to the inventive subject matter.

FIG. 1C depicts a further exemplary light-weight toy according to the inventive subject matter.

FIG. 2A depicts an exemplary kit according to the inventive subject matter.

FIG. 2B depicts an exemplary packing element of the kit of FIG. 2A.

FIG. 3 is an exemplary kit with a near-invisible tether and an articulated puppet that is configured to allow controlled movement of the puppet using the tether.

DETAILED DESCRIPTION

Figure 4A:
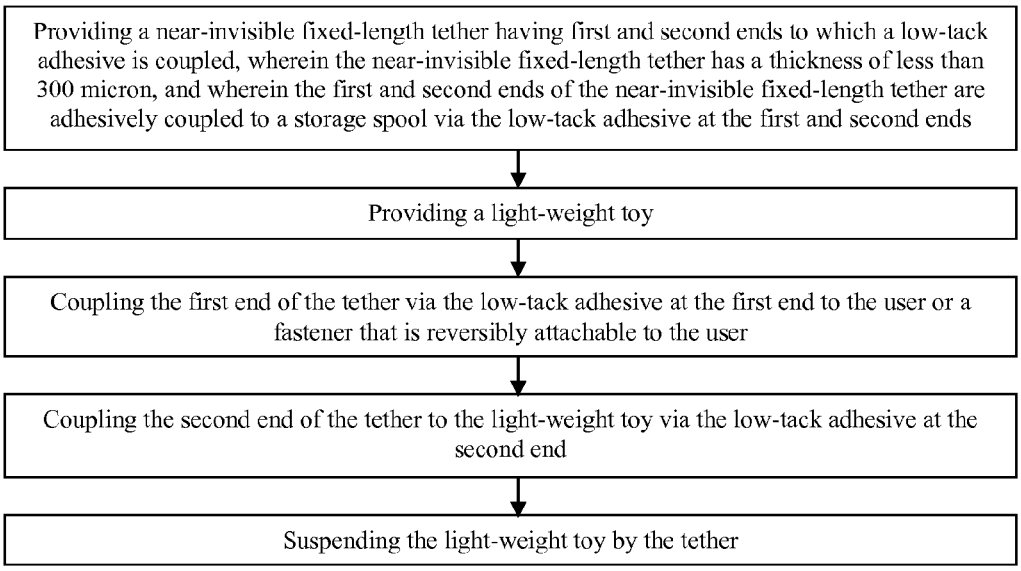
FIG. 4A depicts an exemplary method of using a light-weight toy according to the inventive subject matter.

The inventors have discovered that numerous body-worn toys with near-invisible tethers can be made readily accessible to various users that would otherwise be precluded from such devices by providing a kit comprising the toy and a tether-spool assembly in which one or more tethers are held in a ready-to-use configuration.

Most preferably, the tether is temporarily fastened to the spool using the same implement that also fastens the tether to the object and/or user, wherein the object is a light-weight object (e.g., less than 50 g) that is relatively small (e.g., largest dimension less than 30 cm), and/or has the appearance of plausible autonomous flight, typically implemented by a mechanism that imparts appearance of plausible possibility of flight without actually providing sufficient lift or propulsion for flight. As used herein, the term "mechanism that imparts appearance of plausible possibility of flight" refers to (a) any structure or implement that is recognized (i.e., of similar or identical appearance) as an element in a flying animate (e.g., bird, bat, insect) or inanimate (e.g., airplane, flying disc or ring) object, wherein that element imparts propulsion and/or lift to the animate or inanimate object, wherein (b) that structure or implement is proportioned and positioned in the light-weight toy such that sufficient lift or propulsion for flight of the toy appears possible. For example, one or more airfoils, propellers, or flapping wings are considered mechanism that imparts appearance of plausible possibility of flight. Most typically, movement of such mechanisms is provided by electromagnetic devices, including (stepping) motors, pumps, electromagnetic coil actuators, etc, all of which may be controlled by dedicated or combined control circuitry that is responsive to user input and/or position of the toy relative to a static surface (infra). In contrast, a design element labeled "antigravity thruster" or "jet pack" are not considered mechanism that imparts appearance of plausible possibility of flight.

With respect to the object that is to be coupled to the tether it should be appreciated that numerous objects are suitable in conjunction with the teachings presented herein. However, it is particularly preferred that the object is relatively small and light-weight and has the appearance of plausible autonomous flight. For example, suitable objects include those having a propeller, fixed, flapping, and/or rotating wings, or a toy rocket engine that may or may not provide a flow of air, sparks, or other visual and/or audible effects. Thus, it should be particularly appreciated that suitable objects will have a mechanism that simulates a lift and/or propulsion mechanism, but that such simulated mechanism will not provide sufficient lift or propulsion for flight (allow the object to maintain or increase altitude, or to provide propulsion). Viewed from a different perspective, the mechanism will merely provide a plausible possibility of lift and/or propulsion, but will not enable to object to fly in a predetermined manner using that mechanism. Therefore, the near-invisible tether is used to impart a flying motion to the object. Most typically, one end of the tether is coupled to the object using the modification on that end (e.g., using loop or poster putty) while the other end is coupled to the user (e.g., via the modification to a piece of clothing or body surface). Consequently, it should be recognized that a user can move the object through the air in a flying and/or levitating motion, giving (and/or having) the impression of free flight of the object while the object is actually controlled via the tether. Viewed from a different perspective, it is now possible to impart flight capability to an object having a lift and/or propulsion mechanism that would otherwise not be able to fly using that lift and/or propulsion mechanism. Moreover, as the tether is already prepared for immediate use, even unskilled players will be readily able to enjoy contemplated entertainment devices and methods.

Among other things, especially preferred objects include inanimate objects, including rotating disks, flying saucers ("UFO") and/or UFO-like objects as depicted in FIG. 1A, toy helicopters, toy jets, toy rockets, animate objects including toy birds, toy butterflies, and even entirely imaginary objects, including space aliens, dragons, a Pegasus, a mermaid with flapping fin, or a fairy with flapping wings as depicted in FIG. 1B. It should be appreciated that such objects will include at least one mechanism that imparts appearance of plausible possibility of flight to the toy without providing sufficient lift or propulsion for flight. While not limiting to the inventive subject matter, it should be noted that the object may also be configured to allow propelling of the object along a trajectory (e.g., a spinning disk with fixed wings may be able to fly in a manner similar to a Frisbee) or that the object may appear to be in preparation for flight (e.g., increasing speed of propeller or ability to rotate). For example, the toy may be configured such that the toy has at least some controlled flight behavior (but still uses no propulsion and/or lift from the mechanism). Among other things, where the toy is a UFO, the UFO may be configured as a flying ring, a flying cylinder, or other toy that can be thrown along a trajectory.

In FIG. 1A, the toy 100A has a general appearance of a UFO (flying saucer) in which a plurality of airfoil-shaped structures 110A are disposed above and below a horizontal plane relative to the rim and provide the mechanism that imparts appearance of plausible possibility of flight to the toy without providing sufficient lift or propulsion for flight. Rim 120A has a generally circular configuration and is configured to allow attachment of the airfoil-shaped structures 110A. Most preferably, at least one point of attachment is provided in the toy to which the tether can be inserted and retained by the low-tack adhesive. In the toy of FIG. 1A, the point of attachment 130A is centered with respect to the rim and provides a point of rotation. Point of attachment 130A further includes a cutout in which the tether can be inserted and is sufficiently large to accommodate at least a portion of the low-tack adhesive.

In FIG. 1B, the toy 100B has a general appearance of a fairly or flying insect in which a pair of wing-shaped structures 110B are disposed at the back of the insect or fairy and provide the mechanism that imparts appearance of plausible possibility of flight to the toy without providing sufficient lift or propulsion for flight. Body 120B has a generally longitudinal configuration (e.g., insect like or human-shaped) and is configured to allow attachment of the wing-shaped structures 110B. Most preferably, at least one point of attachment is provided in the toy to which the tether can be inserted and retained by the low-tack adhesive. In the toy of FIG. 1B, the point of attachment 130B is centered with respect to the wings and near or at the center of gravity to allow for level flight. Here, point of attachment 130B is a metallic base to which the tether can be attached via the low-tack adhesive. Control circuit 140B is typically enclosed in the body portion of the toy and is, for example, configured to control movement of the pair of wings as a function of proximity of the toy to a resting surface (e.g., floor, bottom surface of a storage container, body surface, etc.), or configured to control illumination of the pair of wings (e.g., as a function of movement of the pair of wings).

To further increase visual appearance and perceived play value, it is contemplated that the object may comprise additional features that provide auditory and/or visual effects. Most preferably, such features are controllable by a user and/or are controlled by an electronic control circuit that controls the effect(s) in response to movement of the toy, picking up the toy from a resting surface (e.g., shelf, floor, or bottom surface of a dedicated storage container). For example, where the light-weight toy is configured as a toy fairy (having human appearance), a butterfly, a dragon, or as a dinosaur, the mechanism that imparts appearance of plausible possibility of flight may comprise one or more pairs of wings, and the movement of the pair of wings may be controlled by the control circuit as a function of proximity of the toy to a surface (e.g., floor of a room, bottom surface of a storage container, body surface, etc.). The same or additional control circuit may also be used to provide additional effects, for example, by controlling illumination of the pair of wings (e.g., as a function of movement of the pair of wings, or in response to a mechanical or acoustic signal provided by the user). Similarly, where the light-weight toy is configured as a UFO, the mechanism that imparts appearance of plausible possibility of flight will typically comprise a plurality of fixed and/or moving airfoils. Additional visual and/or audible effects can then be implemented similar to the manner as described above.

It should also be recognized that in alternative aspects of the inventive subject matter the object need not be limited to one having plausible possibility of flight, but that non-flying objects are also deemed suitable. Especially preferred alternative objects include puppets, and particularly those in which one or more limbs are controlled by one or more tethers. While it is contemplated that the tether(s) can be attached to the puppet in any manner, it is preferred that the tether connects to the puppet in a substantially horizontal (+/−20 degree from horizontal) manner. Therefore, it is preferred that the puppet is disposed between two posts or other points of coupling. However, single or multiple-post coupling are also deemed suitable. Regardless of the coupling, it should be appreciated that one tether can be used for control of movement while another tether can be used to suspend the puppet, or that suspension and motion control can be effected using a single tether. FIG. 1C provides an exemplary embodiment of such object. Here, puppet 100C is suspended off tether 110C that is (preferably movably) coupled to posts 120C and 120C'. Control tether 130C is also attached to the puppet, routed through or along post 120C and is further coupled to a player 140C (e.g., to wrist or finger).

With respect to suitable tethers, it is generally preferred that the tether may be fabricated from numerous materials and combinations and may have a relatively wide range of thickness so long as such tethers have sufficient tensile strength to carry the weight of the object without breaking, and so long as such tethers are near-invisible to the unaided eye. Used in conjunction with a tether, the terms "near-invisible" and "near-invisible to the unaided eye" are interchangeable and refer to a tether that has a thickness of less than 300 micron, more typically less than 100 micron, even more typically less than 50 micron, and most typically between 5 and 50 micron. Most preferably, contemplated tethers have a dark color and are most typically black or dark blue and have a surface with low reflectivity (e.g., less than 20% of incident light is reflected).

While not limiting to the inventive subject matter, it is generally preferred that the tether will be a single filament or a small filament bundle of less than 10, and more typically less than 5 individual filaments, which is typically prepared from a larger yarn. For example, multifilament KEVLAR™ yarns (aramid yarn commercially available from EI Dupont de Nemours, Inc.) at 10 to 2000 Denier are typically suitable and can be separated into single filaments or small filament bundles. However, and where available, single filaments or small filament bundles may also be commercially obtained. Of course, it should be appreciated that the material is not limited to KEVLAR™, and numerous alternative materials (e.g., polyesters, polyamide, carbon fibers, etc.) are also deemed appropriate.

Regardless of the material and manner of production, it is contemplated that the near-invisible tether will be cut to a predetermined length, and most preferably multiple tethers to a set of predetermined lengths. In most circumstances, suitable tether lengths will be in the range of between 20 cm and 200 cm, more typically between 40 cm and 100 cm, and most typically between 30 cm and 90 cm. At least one of the tethers is then further modified on at least one end to facilitate storage, handling, and attachment to the object and/or user (or static structure such as a post, wall, ceiling, etc.). Particularly suitable modifications of the tether include terminal loops or other structures formed from the tether material to which the object and/or user (or static structure) can be fastened and/or non-tether material that facilitates coupling of the object and/or user (or static structure). In especially preferred aspects, the non-tether material comprises a low-tack material (e.g., poster putty commercially available from Elmer's Glue, Henkel, or 3M), a magnetic material, a small hook-and-loop fastener, a jewelry fastener (e.g., clasp, hook, carabiner clip, etc.), or other implement that allows reversible attachment of the end (and most preferably both ends) of the tether to the object and/or user (or static structure). In particularly preferred aspects, it should be appreciated that such implements will also retain or help retain the tether to the packaging in which the tether and the toy are provided. Most typically, one or more spools are provided around which the tether is then wound.

With respect to the spool it is contemplated that all structures are deemed suitable that allow temporary fastening of the tether to the spool, preferably such that removal of the tether from the spool will not result in entanglement of the tether. Therefore, particularly contemplated spools include 3-dimensional structures including cylindrical, frustoconical, (stepped) pyramidal structures, as well as generally flat structures, including triangle or square-shaped cards, all of which may be notched or otherwise shaped to maintain the tether in a predetermined position. For example, suitable alternative shapes of carriers include (notched) cards, elongated cylinders, irregularly shaped objects, and star-shaped objects, wherein each of these may have separate areas for receiving separate tethers. While not limiting to the inventive subject matter, it is typically preferred that the tether is wound to the spool such that one end of the tether is maintained on or near one end of the spool via the modified end (e.g., via poster putty) while the other end is maintained on or near the other end of the spool via the other modified end. Therefore, it should be appreciated that the tether can be released from the spool in a controlled and tangle-free manner such that one end can drop away from the spool while the other end of the tether is retained on the spool until the user removes that end as well. Thus, it should be noted that the term "spool" as used herein is not limited to a generally cylindrical structure but may have numerous geometries as exemplarily outlined above. It should also be appreciated that the carrier will preferably be configured to provide a fixed length of a tether without permanently retaining one end of the tether to the carrier (e.g., as is the case with a spring-operated spool that allows retracting the tether onto the spool). In further preferred aspects, the packing includes multiple spools, with each of the spools having one tether coupled thereto. As pointed out above, the tethers may have the same length of different lengths. Tethers, spool, and assemblies especially suitable for use herein are described in our co-pending application with the title "Method And Apparatus For Near-Invisible Tethers", filed concurrently herewith which also claims priority to 61/019,174. This co-pending application is incorporated by reference herein.

Consequently, the inventors particularly contemplate a kit that includes a light-weight toy and a near-invisible fixed-length tether having a length and first and second ends, wherein first and second ends of the tether are modified with an adhesive having a tackiness that is sufficient to allow reversible attachment of the first end of the tether to a person and to allow reversible attachment of the second end of the tether to the toy. Most preferably, the light-weight toy has a mechanism that imparts appearance of plausible possibility of flight to the toy without actually providing sufficient lift or propulsion for flight. While not limiting to the inventive subject matter, it is generally preferred that the kit further includes a packaging element (e.g., as part of a plastic carrier for the components of the kit), preferably configured to allow coiled and reversible affixing of the near-invisible fixed-length tether to the packing element using the adhesive on the first and second ends. Therefore, preferred packing elements may comprise a spool that allows coiled and reversible affixing of the near-invisible fixed-length tether, and may further optionally comprise an opening to accommodate at least a portion of the light-weight toy. In yet further contemplated aspects of the inventive subject matter, one or more 'magic wands', typically configured as a simple rod or cylinder, optionally with a terminal modification (e.g., star, spark, light source, etc.) may be provided with the light-weight toy and/or tether to further increase play value. In such cases, the wand may be configured to allow reversible attachment of the tether and/or to allow contact of the wand with a portion of the tether between the ends of the tether. Consequently, it should be appreciated that the light-weight toy can be moved by a player by attaching one end of the tether to the player and the other to the toy while contacting the tether with the wand to so control movement of the toy. Alternatively, or additionally, one end of the tether may be attached to the wand while the other end is attached to the toy.

Most typically, contemplated kits will comprise an instruction that instructs a person to attach the first end of the tether to the person and to attach the second end of the tether to the toy to thereby suspend the toy mid-air, and to support the near-invisible fixed-length tether with at least one finger at a position between the first and second ends (and optionally to further support the near-invisible fixed-length tether with another body portion such as an ear, shoulder, etc.). FIG. 2A depicts an exemplary kit 200A having an instruction 210A (e.g., as described immediately above) and a plurality of tether units 220A formed in the packing element (see below) that comprise a tether to which on at least one end (and more typically on both ends) a low-tack adhesive is coupled, wherein each tether is separately disposed around a tether carrier (e.g., spool, cone structure, etc.). Contemplated kits will further comprise at least one toy 230A, which is preferably a light-weight toy that has a mechanism that imparts appearance of plausible possibility of flight to the toy without actually providing sufficient lift or propulsion for flight. Most preferably, such kits will include the light weight toy as contemplated above and exemplarily illustrated in FIGS. 1A-1C. One exemplary packing element that accommodates the toy and tether(s) is schematically depicted in FIG. 2B. Here, packing element 205B comprises spools 207B, around each of which a single fixed-length tether 209B is wound. Low tack adhesive 212B is attached to each end of the tether and also to a portion of the packing element to so retain the tether in a configuration from which the tether can be easily removed. Packaging element 205B further includes a cutout 203B that is configured to accommodate at least a portion of the flying toy (e.g., UFO of FIG. 1A).

In further alternative aspects, contemplated kits will include a spool to which a near-invisible tether (preferably having a length of at least 90 cm, more preferably at least 120 cm, and most preferably at least 180 cm) is releasably coupled using first and second adhesives at respective ends of the tether, and an articulated puppet that is configured to allow controlled movement of the puppet using the tether when (a) the tether is in horizontal position and (b) coupled to a person using one end of the tether. Preferably, the kit further includes a post that is configured to allow coupling of the tether to the post such that the tether moves along the post. Such kit will allow a user to attach one end of the tether to the user while the articulated puppet is attached to the tether in a position between the ends of the tether such that movement of the tether by the user will result in movement of the puppet. The other end of the tether is coupled to the post (e.g., via roll or pin), typically such that the puppet can also move in a later motion. FIG. 3 depicts an exemplary alternative kit 300 with the puppet. Here kit 300 includes the puppet 310, posts 312, and a spool 320 to which a near-invisible tether 330 is releasably coupled using first and second adhesives 332 and 334 at respective ends of the tether. Where desired, instructions 350 can be provided as a booklet, brochure, or other printed item. The puppet 310 is preferably an articulated puppet that is configured to allow controlled movement of the puppet using the tether when (a) the tether is in horizontal position and (b) coupled to a person using one end of the tether. In especially preferred kits, the post is configured to allow coupling of the tether to the post such that the tether moves along the post, wherein the tether has a length of at least 90 cm.

Figure 4B:
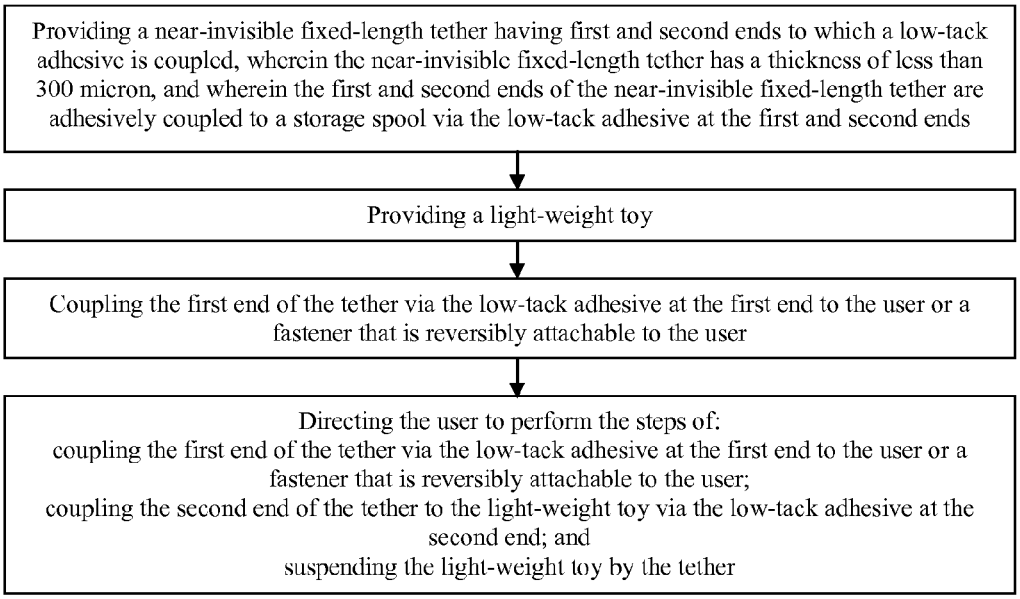
FIG. 4B depicts an exemplary method of instructing a user to set up a light-weight toy according to the inventive subject matter.

FIG. 4A depicts an exemplary method of using a light-weight toy according to the inventive subject matter, while FIG. 4B depicts an exemplary method of instructing a user to set up a light-weight toy according to the inventive subject matter.

Thus, specific embodiments and applications of compositions and methods related to body-worn entertainment devices have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of using a light-weight toy, comprising:

providing a near-invisible fixed-length tether having first and second ends to which a low-tack adhesive is coupled, wherein the near-invisible fixed-length tether has a thickness of less than 300 micron, and wherein the first and second ends of the near-invisible fixed-length tether are adhesively coupled to a storage spool via the low-tack adhesive at the first and second ends;

providing a light-weight toy;

coupling the first end of the tether via the low-tack adhesive at the first end to the user or a fastener that is reversibly attachable to the user;

coupling the second end of the tether to the light-weight toy via the low-tack adhesive at the second end; and suspending the light-weight toy by the tether.

2. The method of claim 1 wherein the storage spool is a portion of a carrier.

3. The method of claim 2 wherein the carrier is configured to engagingly receive at least a portion of the light-weight toy, and wherein the light-weight toy is affixed to the carrier.

4. The method of claim 2 wherein the carrier comprises a second storage spool with a second tether.

5. The method of claim 1 wherein the light-weight toy comprises a fixed airfoil, a movable airfoil, a wing, or a propeller.

6. The method of claim 1 wherein the light-weight toy is configured as an object selected from the group of a UFO, a spinning disk, an airplane, a fairy, a Pegasus, a dinosaur, and a butterfly.

7. The method of claim 1 wherein the light-weight toy is configured as a puppet.

8. The method of claim 7 wherein the puppet is configured as an articulated puppet.

9. The method of claim 1 wherein the light-weight toy is configured as a fairy having a pair of wings.

10. The method of claim 9 wherein the light-weight toy further comprises a control circuit that controls movement of the pair of wings.

11. The method of claim 9 wherein the light-weight toy further comprises a control circuit that controls illumination of the pair of wings, optionally as a function of movement of the pair of wings.

12. The method of claim 1 wherein the near-invisible tether has a diameter of less than 50 micron.

13. The method of claim 1 wherein the near-invisible tether has a length of between 30 cm and 100 cm.

14. The method of claim 1 wherein the adhesive is selected from the group of wax, and a low-tack polymer.

15. The method of claim 1 wherein the light-weight toy has a weight of between 5 and 50 gram.

16. A method of instructing a user to set up a light-weight toy, comprising:

providing a near-invisible fixed-length tether having first and second ends to which a low-tack adhesive is coupled, wherein the near-invisible fixed-length tether has a thickness of less than 300 micron, and wherein the first and second ends of the near-invisible fixed-length tether are adhesively coupled to a storage spool via the low-tack adhesive at the first and second ends;

providing a light-weight toy;

directing the user to perform the steps of:

coupling the first end of the tether via the low-tack adhesive at the first end to the user or a fastener that is reversibly attachable to the user;

coupling the second end of the tether to the light-weight toy via the low-tack adhesive at the second end; and suspending the light-weight toy by the tether.

17. The method of claim 16 wherein the light-weight toy is configured as an object selected from the group of a UFO, a spinning disk, an airplane, a fairy, a Pegasus, a dinosaur, and a butterfly.

18. The method of claim 16 wherein the light-weight toy is configured as a puppet.

19. The method of claim 18 further comprising a step of directing the user to couple the tether to a post to thereby allow suspension of the puppet while the tether is in a horizontal position.

20. The method of claim 16 further comprising a step of including a second storage spool with a second tether.

* * * * *